United States Patent [19]

Pamart

[11] Patent Number: 4,475,721

[45] Date of Patent: Oct. 9, 1984

[54] INDUCTION HEATED CASTING CHANNEL WITH GRAPHITE SLEEVE

[75] Inventor: Joël Pamart, Chalon, France

[73] Assignee: Pont-A-Mousson S.A., Nancy, France

[21] Appl. No.: 528,002

[22] Filed: Aug. 31, 1983

[30] Foreign Application Priority Data

Sep. 13, 1982 [FR] France ..... 82 15556

[51] Int. Cl.[3] ..... B22D 35/06; C21C 5/42

[52] U.S. Cl. ..... 266/236; 222/593

[58] Field of Search ..... 266/236, 237, 239, 280; 164/507, 513, 493; 222/593; 373/79, 115, 142, 143, 161, 162

[56] References Cited

U.S. PATENT DOCUMENTS 2,882,570 4/1959 Brennan ..... 222/593

3,435,992 4/1969 Tilsdale et al. ..... 266/236

3,604,598 9/1971 Kappmeyer et al. ..... 222/593

3,623,541 11/1971 Schmitz ..... 266/236

*Primary Examiner*—L. Dewayne Rutledge

*Assistant Examiner*—Robert L. McDowell

*Attorney, Agent, or Firm*—Sughrue, Mion, Zinn, Macpeak & Seas

[57] ABSTRACT

A fusing furnace casting channel 13 is surrounded by an induction heating coil 17 embedded in a refractory lining 12. A graphite sleeve 20 having a refractory inner coating 16 defines the casting channel. The sleeve serves as a permanent, single turn secondary winding such that the channel may be preheated even when no molten metal is present in the channel, which would ordinarily act as the secondary winding or core. This enables the casting channel to be maintained at a high temperature between successive casting operations.

4 Claims, 4 Drawing Figures

Fig. 2
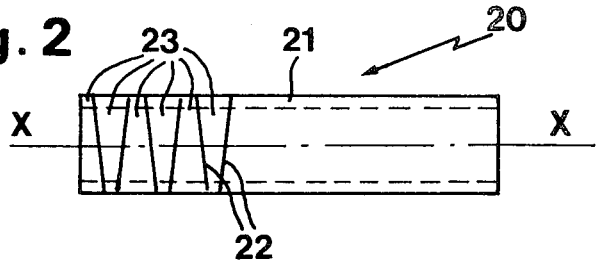
Fig. 3
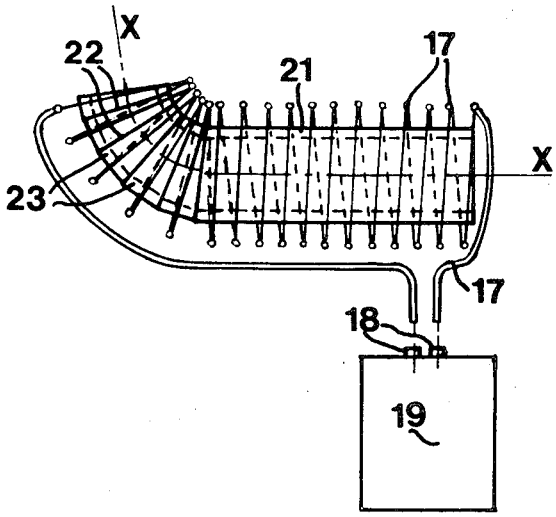
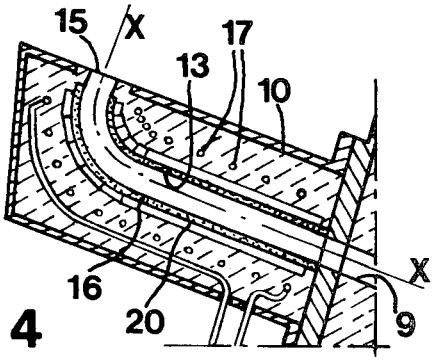
Fig. 4

INDUCTION HEATED CASTING CHANNEL WITH GRAPHITE SLEEVE

BACKGROUND OF THE INVENTION

This invention pertains to an induction heated casting channel or drain of a high temperature metal alloy fusing furnace or the like.

Superalloys are divided into three categories: austenitic steel and alloys which contain more than 20% of iron, basically comprised of iron, nickel, and chromium or iron, chromium, nickel, cobalt, and austenite, and alloys containing less than 20% of either nickel or cobalt based iron. Superalloys contain elements which can form carbides or intermetal phases: molybdenum, tungsten, vanadium, niobium, titanium, and aluminum. Their useful characteristics are their mechanical and chemical resistance at temperatures exceeding 900° or 1,000° C., and their flow resistance.

They are used to mold mechanical parts designed to resist high temperatures, such as parts for metallurgical furnaces, parts for the aeronautics, aerospace, and automobile industries, especially rotors for gas turbines or turbojet blades, exhaust valves, heating elements and maintenance teeth for industrial furnaces, tubular products for refineries in the oil industry, etc. Alloyed or low-alloy steel is used, among other things, for molding parts for the mechanical and building industries (building steel).

The casting channel for such an alloy can be that of a fusing furnace or else can be connected to a foundry casting ladle.

A metal alloy at high casting temperature solidifies quickly when there is a drop in temperature. In order to prevent such solidification, it is preferred to maintain the metal alloy inside the heated furnace as long as possible, making sure that it does not stagnate in the furnace casting drain or channel between two successive castings designed to fill a mold applied to the outlet orifice of the casting drain. For that reason, a rotating fusing furnace is used which tilts in order to empty the drain between two successive castings back inside the heated furnace by gravity flow.

An induction coil is also embedded inside the refractory lining of the casting drain, along its entire length, in order to induce a secondary heating current in the liquid alloy when it fills the drain just before and during a casting, thus reducing the chances of solidification of the molten alloy. Such a drain equipped with an embedded induction coil does not generate heat in the absence of liquid metal to serve as a secondary winding or core, however, such as between two successive castings when the drain is lifted to make the liquid metal alloy run back down into the furnace. The result is that, when casting resumes, a risk of initial solidification remains when the metal alloy enters the inadequately heated casting drain.

The problem thus exists to eliminate the cooling and solidification of a metal alloy at a casting temperature of at least 1,400° C. inside a casting channel, between two successive castings of a mold, by heating the channel even when it does not contain any liquid metal. This problem could be solved, theoretically at least, by introducing inside the wall of the channel electric heating resistors, as is known. In practice, however, heating a casting channel with a Joule effect is difficult to achieve if not impossible; because of expansion it is difficult to embed a heating resistor inside a refractory fitting, and moreover it is difficult to couple a high intensity current to such an embedded resistor because of the high potential that is needed. For that reason induction heating is preferred since a properly cooled coil does not raise any expansion problems when it is embedded inside the refractory fitting, and the current coupling does not raise any problems, in spite of the powerful current potential required as a result of interposing an aperiodic generator between the channel coil and an electric current source.

SUMMARY OF THE INVENTION

This invention resolves the problem by providing, surrounding the casting bed of the channel and coaxially therewith, a graphite susceptor sleeve which is traversed by an induced or secondary heating current when the primary induction coil is energized. With this arrangement the casting channel is induction heated even when no liquid metal alloy is present inside of the channel, so that the channel can be preheated before the first casting as well as between two successive castings at a temperature which ensures the continued fluidity of the metal alloy when it is introduced inside the channel.

BRIEF DESCRIPTION OF THE DRAWINGS

FIG. 2 is a detailed elevation view, on a larger scale than FIG. 1, of a graphite sleeve according to the invention, prior to its final shaping, FIG. 3 is a schematic view which illustrates the shaping and induction heating of the sleeve, and FIG. 4 is a partial sectional view which corresponds to FIG. 1 of the casting channel lifted in a waiting position between two successive castings.

DETAILED DESCRIPTION OF THE PREFERRED EMBODIMENT

Figure 1:
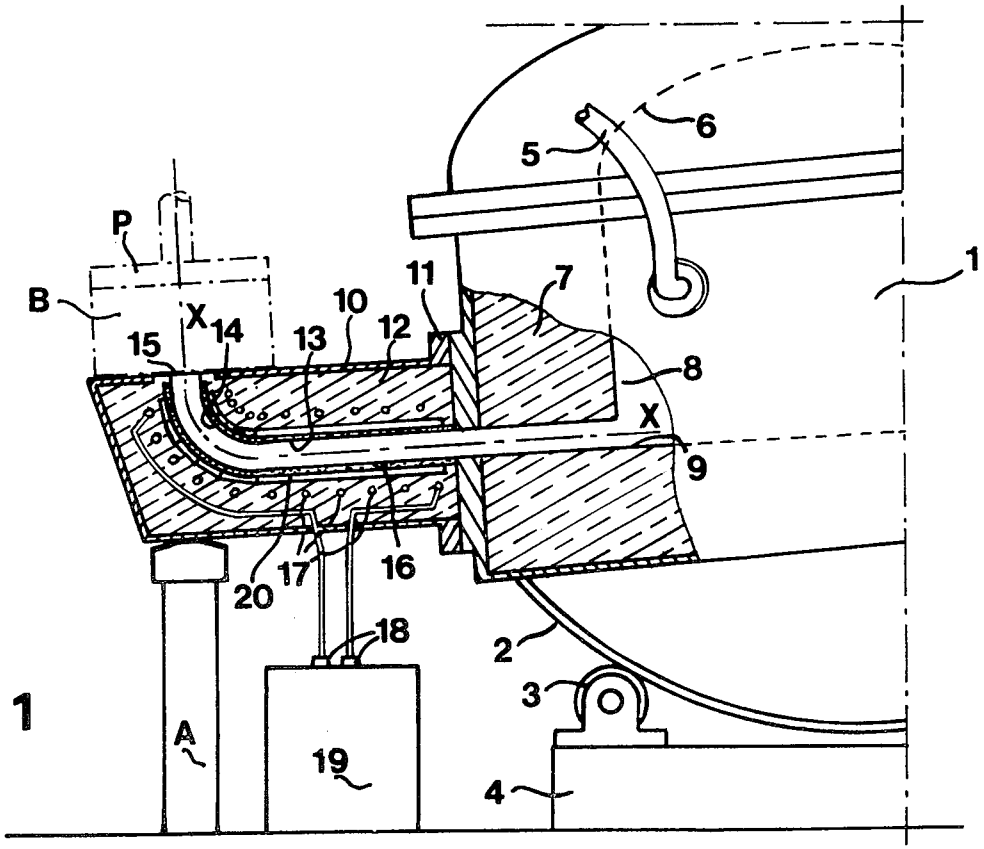
FIG. 1 is a schematic elevation view with a partial section of an electric tilting furnace equipped with a casting channel according to the invention, with the channel in the casting position.

As shown in FIG. 1, the invention is applied to an electric fusing furnace 1, of known type, which rotates or tilts about a circular arc track 2 carried by rollers 3 (only one is shown) mounted on a support bed 4. The furnace 1 has a vaulted dome 6 which reverberates heat. The partial section shows the refractory lining 7 of the furnace 1 and its inner volume 8, which leads to a casting orifice through a duct 9. The duct 9 is connected to an outer metal coffered casting drain 10, which is removably affixed at one end by a bridle 11 to the furnace 1 and supported at the other end by a vertical prop A which can be adjusted in height by means, not shown, for instance a screw thread and gear wheel. The drain 10 has a silicoaluminous refractory lining 12 connected to the duct 9, which secures a cylindrical casting channel 13.

The channel 13, with an X—X axis, includes a straight section which can be tilted on either side of the horizontal during the inclining of the furnace 1, and a bent section 14 which leads upwardly to a casting orifice 15. A mold B is applied to the casting orifice by a pressure plate P activated by a jack, not shown.

The interior 8 of the furnace is placed under pressure through a duct 5 from an inert gas source, such as argon or nitrogen, to displace the liquid metal alloy to the casting orifice without risk of oxidizing the molten alloy upon contact with the gas.

The drain 10 and channel 13 are heated, and to this end a copper induction coil 17 is embedded inside the refractory lining 12, coaxially with the X—X axis, and follows the bent outline of the channel 13 along almost its entire length. As is known, the hollow induction coil 17 is internally cooled by water, which eliminates all expansion problems with encasing the coil within the refractory lining 12. The ends of the coil are connected to two terminals 18 of an aperiodic electric current generator 19. In a conventional manner, induction heating of the liquid metal alloy is obtained when the alloy completely fills the channel 13 and the coil 17 is fed with electric current: the primary is the coil 17 and the secondary is the molten metal alloy.

According to the invention, with regard to heating the channel 13 even in the absence of liquid metal inside the channel, a graphite sleeve 20 is provided surrounding the casting bed of the channel. The sleeve is coaxial to the channel 13 and thus to the X—X axis, and constitutes a permanent secondary winding in the induction system of which the coil 17 is the primary. The sleeve 20 is encased or inserted, by being laid with wide dimensional tolerances, into the refractory lining 12 close to the inner wall which acts as the flow bed of the liquid metal alloy.

Preferably, the graphite susceptor sleeve or pipe 20 is bent, beginning with straight preform 21 (FIG. 2). It includes a straight tubular element which, along part of its length from one end, is sectioned through planes 22 oblique to the X—X axis, alternately tilted in one direction and in the opposing one, the two tilts being symmetrical, into tubular segments 23. The diametrically opposing generators of the segments are alternately short and long. By successively rotating each segment by 180° in relation to the previous one, by slicing on the oblique partition planes 22, rotating first the segment that is adjacent to the straight preform section, the tubular elbow of FIG. 3 is obtained.

To complete the channel 13 and to protect the graphite sleeve 20 from direct contact with the liquid metal alloy, especially in the joints between the segments 23, a continuous inner coating 16 of refractory material is applied to the sleeve and covers the chinks or joints between the segments. The coating 16 is thus an accurate completion of the channel 13 even if the lining 12 displays an inner cavity having wide dimensional tolerances. The coating represents the flow bed of the liquid metal alloy with which it is designed to be in direct contact.

During the fusing of its metal load, the furnace 1 is preferably tilted so that the casting drain 10 is upwardly lifted above the surface of the liquid metal, as shown in FIG. 4, whereat the drain 10 no longer rests on the prop A. During this fusing period the channel 13 remains empty and is used for induction preheating of the coating 16 via the graphite sleeve 20. The electric current fed by the generator 19 into the primary coil 17 induces a secondary heating current in the sleeve 20, which in turn heats the coating 16.

When the fusing of the furnace metal load is finished, the furnace is tilted in the position of FIG. 1 for casting until the drain 10 is supported on prop A. The liquid metal penetrates inside the preheated casting channel 13, without rising to the orifice 15 on which the mold B is applied since the gas pressure above the liquid metal inside the furnace is initially at a low value. The coil 17, which is still fed with electric current, induces a secondary current in the liquid metal to maintain it at a desired temperature, which is substantially greater than 1,400° C., until the gas pressure in the furnace 1 is raised to force the liquid metal through the orifice 15 and into the mold B.

Thus, the liquid metal or alloy held in the casting channel 13 or traversing it remains heated under all circumstances at a temperature which is almost as high as that which prevails inside the furnace.

Obviously, the invention also applies to the induction heating, in the absence of liquid metal, of a furnace channel or an insulated channel which is fed by a simple casting ladle.

What is claimed is:

1. A casting channel apparatus for molten metal including means defining a casting channel (13), a refractory lining (12) surrounding said channel, and a cooled induction heating coil (17) embedded in said lining and surrounding said channel over substantially its entire length, said coil being energized by an aperiodic electrical generator (19), characterized by: a multi-segment graphite susceptor sleeve (20) surrounding said channel over said coil wherein said casting channel and graphite sleeve both include a straight portion and an upwardly bent portion (14) leading to a casting orifice (15), the interior of said sleeve being covered with a continuing coating of refractory material defining a flow bed of said channel, said sleeve serving as a permanent secondary to enable the heating of said channel upon energization of said coil even in the absence of molten metal within said channel.

2. An apparatus according to claim 1, wherein the bent portion of the graphite sleeve includes a plurality of tubular segments (23) joined to form a substantially continuous curve.

3. An apparatus according to claim 2, wherein the straight portion comprises one end of a tubular preform (21) and the bent portion (14) comprises the other end of said tubular preform which has been partitioned by oblique planes (22) in opposite symmetrical directions such that diametrically opposing generators of said segments are alternately short and long; said segments being disposed so that like sized generators are adjacent to each other; one end of said bent portion being attached to said straight portion to form a substantially continuous curve from said straight portion to the other end of said bent portion.

4. An apparatus according to claim 3, wherein the tubular segments (23) are successively rotated 180° starting with the segment most adjacent the straight portion.

* * * * *